US005226493A

United States Patent [19]

Watkins et al.

[11] Patent Number: 5,226,493

[45] Date of Patent: Jul. 13, 1993

[54] WELL APPARATUS

[75] Inventors: Bruce J. Watkins; Blake T. DeBerry, both of Houston, Tex.

[73] Assignee: Dril-Quip, Inc., Houston, Tex.

[21] Appl. No.: 893,788

[22] Filed: Jun. 5, 1992

[51] Int. Cl.[5] ..... E21B 23/00

[52] U.S. Cl. ..... 166/237

[58] Field of Search ..... 166/237-240, 166/381, 377, 373

[56] References Cited

U.S. PATENT DOCUMENTS 4,715,445 12/1987 Smith, Jr. ..... 166/237 X
4,989,679 2/1991 Chaffaunt ..... 166/237 X
5,048,612 9/1991 Cochran ..... 166/237 X
5,158,142 10/1992 Miszewski et al. ..... 166/237 X

*Primary Examiner*—Thuy M. Bui
*Attorney, Agent, or Firm*—Vaden, Eickenroht, Thompson, Boulware & Feather

[57] ABSTRACT

An apparatus for use in lowering a mandrel type casing hanger into a well bore for landing within a casing, and then, when the hanger is so landed, rotating the casing connecting it to a mudline hanger installed at the subsea level in either rotational direction without disconnecting the threaded connection of the apparatus to the mandrel type hanger.

6 Claims, 2 Drawing Sheets

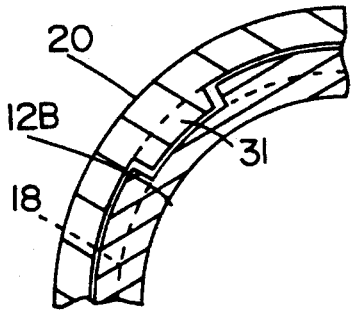
FIG. 2
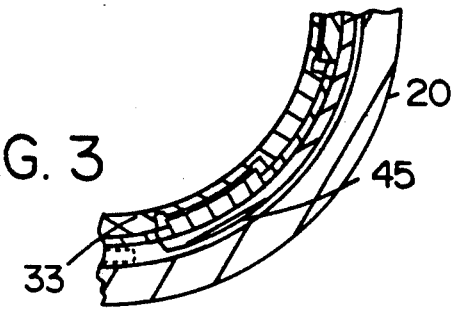
FIG. 3
FIG. 4
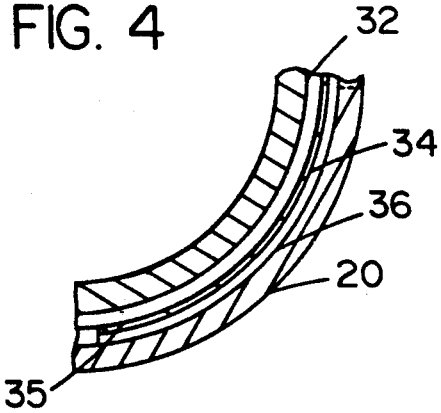
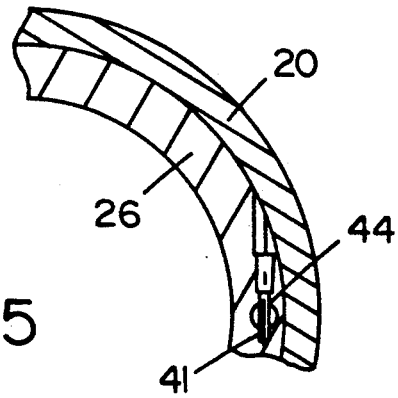
FIG. 5

WELL APPARATUS

This invention relates generally to well apparatus, and, more particularly, to improvements in apparatus for use in lowering a well pipe into a well bore and then rotating the well pipe in opposite rotational senses when so lowered.

As discussed in Patent No. 4,995,464, assigned to the assignee of the present application, it may be necessary to connect a mudline casing hanger installed at the ocean floor to a mandrel or solid bowl type casing hanger to be suspended from a wellhead at the surface. As well known in the art, mudline hangers frequently have circulating ports which must be selectively opened and closed by rotation of tubular parts of the mudline hanger in opposite rotational senses with respect to one another. It would, of course, be desirable to so rotate the parts through the casing connecting the mudline hanger to the mandrel type hanger by application of torque through the tool on which the casing hangers are run into the well bore. However, conventional running tools are connectible to the mandrel type hanger by threads which make up in one direction of rotation, such that rotation in the opposite direction for the purpose of opening or closing the ports in the mudline hanger would release this connection. As a result, it has been necessary in performing operations of this type to suspend the casing at the surface by means other than a mandrel type hanger, or, alternatively, to use two or more tools requiring extra trips into and out of the well bore, one to lower the hangers into the well bore and the other to apply the necessary torque to the parts of the mudline hanger for opening and closing the circulating ports.

The primary object of this invention is to provide apparatus which enables the well pipe to be so lowered and then rotated in opposite directions, and thus, in the environment above described, the hangers to be run and the ports to be opened and closed in a single trip.

This and other objects are accomplished, in accordance with the present invention, by apparatus which includes a lower member adapted to be connected to the well pipe, an upper member adapted to be connected to a pipe string for raising or lowering therewith, and a clutch assembly carried by the upper member for relative vertical movement with respect thereto and adapted to be threadably connected to and disconnected from the lower member. More particularly, the clutch assembly has means which is operable, upon raising the upper member to an upper position with respect to the assembly, for rotating the lower member with the pipe string in both rotational directions without disconnecting the assembly from the lower member, and operable, upon lowering of the upper member to a lower position with respect to the assembly, for connecting the assembly to or disconnecting the assembly from the lower member.

In accordance with the preferred and illustrated embodiment of the invention, the clutch assembly includes a first sleeve carried by the upper member for relative vertical movement with respect thereto, and a second sleeve supported by and rotatable with respect to first sleeve, with the first sleeve being provided with the means for threadably connecting to or disconnecting from the lower member, and the second sleeve and lower member for being provided with means for rotating one with the other when the first sleeve is connected to the outer member. As illustrated the sleeves are arranged concentrically of one another and the lower end of the upper member, with the second sleeve concentrically within the first sleeve.

More particularly, the clutch assembly further includes means which, when the first sleeve is connected to the lower member, is operable, upon raising of the upper member with the pipe string to an upper position with respect to the first sleeve, for rotating the second sleeve and thus the lower member with the pipe string in both rotational directions, without rotating the first sleeve and thus without disconnecting the first sleeve from the lower member, and, upon lowering of the upper member with the pipe string to a lower position with respect to the first sleeve, for rotating the first sleeve with the pipe string and thus permitting it to be threadably connected to or disconnected from the lower member.

As shown, the means for rotating the lower member with the pipe string comprises first slots and lugs on the upper member and second sleeve non-rotatably engageable in the raised position of the upper member, and the means for connecting the assembly to or disconnecting the assembly from the lower member comprises second slots and lugs on the upper member and first sleeve non-rotatably engageable in the lowered position of the upper member, with the first slots and lugs being relatively rotatable when the second slots and lugs are engaged and the second slots and lugs being relatively rotatable when the front slots and lugs are engaged.

In the drawings, wherein like reference characters are used throughout to designate like parts;

Figures 1A, 1B:
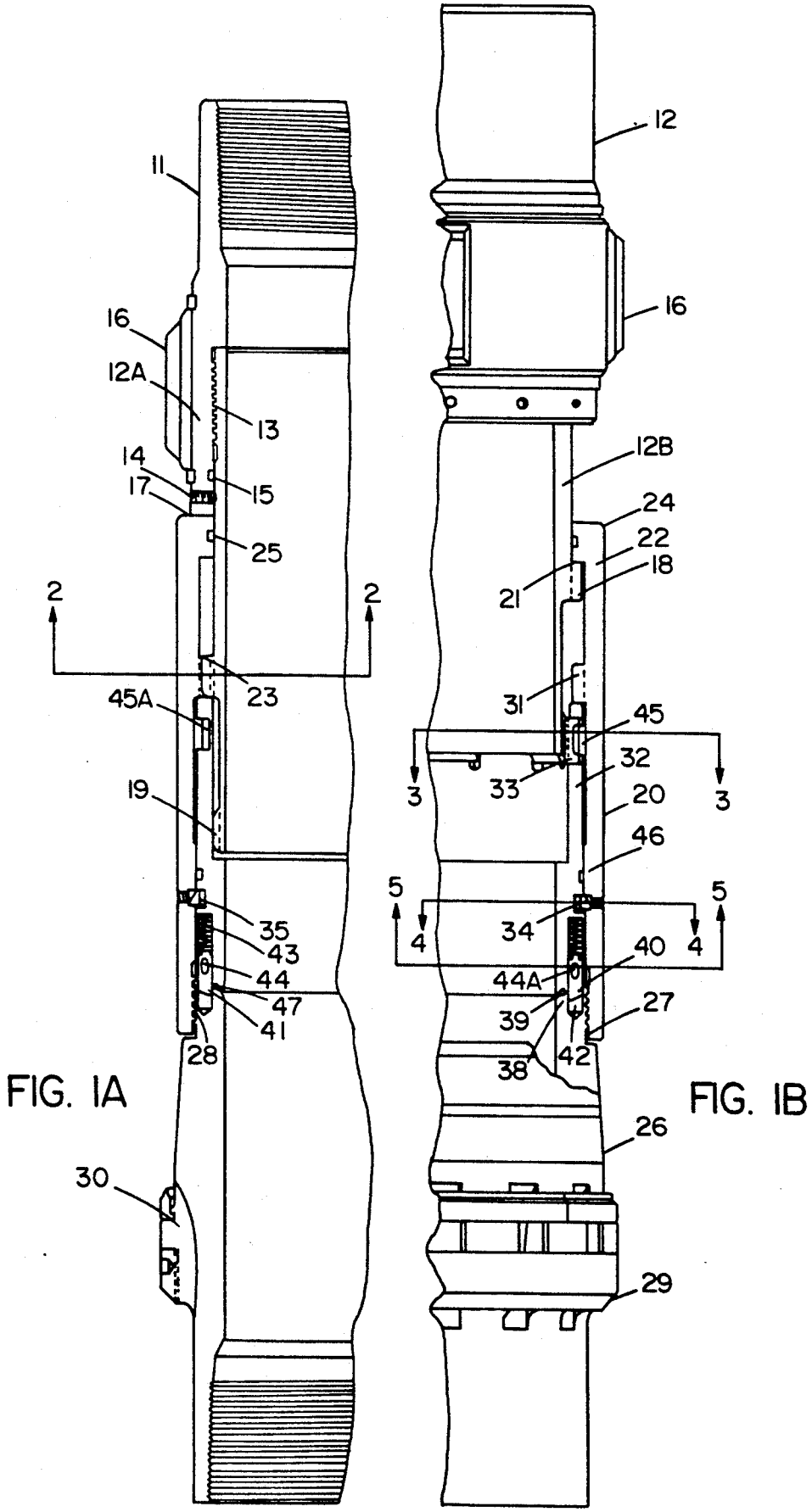
FIG. 1A is a vertical sectional view of the left hand side of apparatus constructed in accordance with this invention, and showing the upper member thereof lowered to a position for connecting the outer sleeve of the clutch to or disconnecting it from the lower member.
FIG. 1B is a view of the right hand side of the apparatus, partly in section and partly in elevation, but showing the upper member raised to a position for rotating the lower member and thus the inner sleeve with the upper member and thus with the pipe string in either or both rotational directions without disconnecting the outer sleeve and lower member.

FIG. 2 is a cross sectional view of the apparatus as seen along broken lines 2—2 of FIG. 1A; and FIGS. 3, 4 and 5 are cross sectional views of the apparatus as seen along broken lines 3—3, 4—4, and 5—5, respectively, of FIG. 1B.

With reference now to the details of the above described drawings, the overall apparatus, which is indicated in its entirety by reference character 10, is shown to include an upper tubular member comprising an upper tubular section 12A having threads at its upper end for connection into the lower end of a pipe string by which it may be raised and lowered within a wellbore, and a lower tubular section 12B threadably connected at 13 to the lower end of the upper tubular section. The sections are maintained in threaded in engagement by set screws 14 and are sealed with respect to one another by means of an O-ring 15 carried by the inner diameter of the upper section. Stabilizer blades 16 are carried about the outer diameter of the upper section of the tubular member 10 to maintain it generally centered in the wellbore.

The lower end of the tubular section 12B extends downwardly from an annular shoulder 17 about the upper tubular section 12A and has upper and lower slotted flanges 18 and 19 formed about its outer diameter. The slotted flange 18 extends outwardly from an enlarged upper diameter portion of the lower section 12B, and the slotted flange 19 extends outwardly from a reduced outer diameter portion of the lower end of the section 12B. The upper flange 18 is spaced beneath the shoulder 17, and the lower flange 19 is spaced beneath the upper flange 18 in a manner and for a purpose to be described to follow.

Apparatus 10 also includes a first sleeve 20 which is disposed about and vertically reciprocal with respect to the upper tubular member between the lower position shown in FIG. 1A in which the upper tubular member is retracted with respect to the first sleeve and the upper position of FIG. 1B wherein it is extended with respect thereto. In the extended position of the upper member, a shoulder 21 on a flange 22 about the inner diameter of the upper end of the sleeve 20 seats upon a shoulder 23 on the upper end of the slotted flange 18 of the upper tubular member so as to support the sleeve 20 from the upper tubular member. Conversely, in the retracted position of the upper tubular member shown in FIG. 1A, shoulder 17 on the upper tubular member is seated upon a shoulder 24 on the upper end of the sleeve 20 so as to limit further downward movement of the upper tubular member with respect to the sleeve 20. An O-ring 25 on the inner diameter of flange 22 sealably forms a sliding seal between the upper tubular member and the sleeve 20.

The apparatus 10 further includes a lower tubular member 26 which has threads 27 about a reduced outer diameter portion of its upper end adapted to be threadably connected to or threadably disconnected from threads 28 about the lower end of the inner diameter of the sleeve 20. As previously described, in the illustrated embodiment of the invention, the tubular member 26 is a mandrel or a solid bowl type casing hanger having threads on the lower end of its inner diameter for connection to casing adapted to extend downwardly to connect with a mudline casing hanger, and an annular seat 29 thereabout adapted to land upon a seat in a surface wellhead (not shown) and having slots 30 formed therethrough to permit the passage of well fluid through the annular space between the casing and the wellbore and wellhead housing in which the hanger is suspended. As shown, the outer diameter of the seat is no greater than the outer diameter of the centralizer 16 and thus is protected as the hanger is raised and lowered with respect to its seated position in the wellhead.

When the upper tubular member is in its lower position with respect to the sleeve 20, as shown in FIG. 1A, the slots formed within flange 18 fit relatively closely over circumferentially spaced apart lugs 31 extending inwardly from the inner diameter of the sleeve 20 so that, with the lower end of the sleeve 20 threadably connected to the lower member 26, the running string and upper tubular member may be rotated through the running string from which the upper tubular member is suspended in order to impart right hand rotation to the threads 28 for making them up with the threads 27, or alternatively, left hand rotation in order to disconnect the threads 28 from the threads 27.

The apparatus 10 further includes a second sleeve 32 which is disposed concentrically within the sleeve 20 for vertical movement with it, but which is rotatable with respect to the outer sleeve and thus with respect to the lower end of upper tubular member when the tubular member and outer sleeve are engaged for rotation. More particularly, lugs 33 are carried about the upper end of the inner diameter of the sleeve 32 for fitting relatively closely within slots in the slotted flange 19 when the upper tubular member is in the raised position with respect to the sleeves, as shown in FIG. 1B. In this position, of course, the lugs 31 are removed from the slots in the flange 18, so that the inner sleeve 32 is free to rotate with respect to the outer sleeve.

As shown, the inner sleeve is carried from the outer sleeve by means a C-Ring 34 which is normally expanded within a recess 35 about the outer diameter of the inner sleeve 32 for disposal within a recess 36 in the inner diameter of the outer sleeve 20, and the upper end of the inner sleeve is engaged with a downwardly facing shoulder on the slotted flange 31 of the outer tubular member, to hold it against upward movement with respect to the outer sleeve. As indicated, the normally expanded C-ring may be contracted inwardly to permit disassembly of the inner sleeve from the outer sleeve by means of said screws 37 mounted in the outer sleeve.

The lower end 38 of the inner sleeve 32 is adapted to be seated upon the upper end 39 of the lower tubular member 26 when the outer sleeve 20 is threadably made up with the lower member. A series of holes 40 extend upwardly within the lower end of the inner sleeve to receive pins 41, which, in their lower positions, extend into opposing holes 42 in the upper end of the lower tubular member. More particularly, the pins 41 are urged downwardly to their lower positions by means of coil springs 43 compressed between the upper ends of the holes and the upper ends of the pins, and a pin 44 extends across the recess through a slot 44A in each pin 41 to limit its downward movement. Since the inner sleeve is free to rotate with respect to the outer sleeve, it may be turned to a position to permit the pins 41 to move into the holes 42, and, when so disposed, prevent relative rotation between the inner sleeve and the lower tubular member 26, whereby the latter may be rotated with the inner sleeve when lugs 33 are within slots in flange 19 and lugs 31 are out of the lots in flange 18.

The lugs 33 about the inner diameter of the inner sleeve are received in slots 45 formed in the inner sleeve for radial movement with respect thereto. More particularly, each such lug comprises circumferentially spaced apart ring segments which, as best shown in FIG. 3, are surrounded by a C-ring 45A which is normally contracted to move the lugs to their innermost positions projecting inwardly of the inner diameter of the inner sleeve to engage in the slots of flange 19. The lugs are located in their innermost position by engagement of the C-ring with flanges on the opposite sides of the recess 45.

As previously described, when the upper tubular member is in its raised position to dispose lugs 33 in the slots of flange 19, the slots in the flange 18 have been raised above the lugs 31 on the outer sleeve so as to permit the outer sleeve and the upper tubular member to rotate with respect to one another, whereby the upper tubular member may be rotated in either rotational direction, through the well pipe from which is suspended in order to in turn rotate the inner sleeve in either rotational direction. This rotation is of course transmitted through the pins 41 to the lower tubular member so as to permit it to in turn rotate the casing suspended therefrom in either direction, and thus, in the case of a mandrel type casing hanger from which a mudline hanger is suspended, to open and close the ports in the mudline hanger. Since the outer sleeve is no longer rotatably connected to the upper tubular member, it is free to rotate with the lower tubular member and thus not disconnect therefrom.

As shown, a seal ring 46 is carried about the outer diameter of the inner sleeve to form a sliding seal with the inner diameter of the outer sleeve. Additionally, a packing 47 is carried on the shoulder at the lower end of the inner tubular member for sealing with respect to the upper end of the lower tubular member so as to contain pressure within the casing.

Upon raising of the upper tubular member, the flange 19 moves into a position opposite the radially retractable and expandable lugs 33 and is then rotated to permit the lugs to snap into the slots. Thus, there is little or no risk of damage to the lower ends of the lugs or the upper ends of the flange 19, as might occur when the upper tubular member is raised, especially under the influence of pressure tending to "pump-out" the upper tubular member. That is, the tapered upper end of the flange 19 will merely wedge the tapered lower ends of the lugs 33 outwardly until the shoulder 23 of the upper tubular member engages the shoulder 21 on the outer sleeve, at which time the upper tubular member may be rotated with its pipe string to a position in which the lugs will snap into the slots in the flange 19.

In summary, and in order to assemble the apparatus, the upper tubular member is moved to its lower positon, as shown in FIG. 1A, to permit the threads 28 to be made up with the threads 27 by right hand rotation of the upper tubular member and thus the outer sleeve through the lugs 31 and slots in the flange 18 and permit the pins 41 to move into the holes 42 so as to connect the inner sleeve and the lower tubular member against relative rotation. With the outer sleeve thus connected to the lower tubular member, the upper tubular member may be raised to the position FIG. 1B until the shoulder 23 engages the shoulder 21 to raise the slots at the flange 19 into non-rotatable engagement with the lugs 33. Hence, with the upper tubular member so raised, it may be rotated through the pipe string from which it is suspended to rotate the lower tubular member and thus the casing suspended and the mudline hanger, in opposite rotational directions for the purposes described. More particularly, this is accomplished without risk of disconnecting the outer tubular member from the lower tubular member, since the lugs 31 are no longer engaged in the slots of the flange 18, so that the outer sleeve is free to rotate with rather than relative to the lower tubular member.

Then, of course, in the event the upper tubular member and the sleeves are to be disconnected, the upper tubular member need only be lowered to its lower position, and rotated to the left to disengage the right hand threads 27 and 28. This is possible, of course, despite the non-rotatable engagement of the inner sleeve with the lower tubular member, since the slots in the flange 19 have been moved out of non-rotatable engagement with the lugs 33.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in lowering a well pipe into a well bore and rotating it in opposite direction senses when so lowered, comprising a lower member adapted to be connected to the well pipe, an upper member adapted to be connected to a well string for raising or lowering therewith, and a clutch assembly carried by the upper member for relative vertical movement with respect thereto and adapted to be threadably connected to and disconnected from the lower member, said clutch assembly having means operable, upon raising the upper member to an upper position with respect to the assembly, for rotating the lower member with the pipe string in both rotational directions without disconnecting the assembly from the lower member, and operable, upon lowering of the upper member to a lower position with respect to the assembly, for connecting the assembly to or disconnecting the assembly from the lower member.

2. Apparatus for use in lowering a well pipe into a well bore and rotating it in opposite direction senses when so lowered, comprising a lower member adapted to be connected to the well pipe, an upper member adapted to be connected to a well string for raising or lowering therewith, and a clutch assembly comprising a first sleeve carried by the upper member for relative vertical movement with respect thereto, a second sleeve supported by and rotatable with respect to first sleeve, means for threadably connecting the first sleeve to the lower member, means for connecting the second sleeve to the lower member for rotation therewith when the first sleeve is connected to the outer member, and means which, when the first sleeve is connected to the lower member, is operable, upon raising of the upper member with the pipe string to an upper position with respect to the first sleeve, for rotating the second sleeve and thus the lower member with the pipe string in both rotational directions, without rotating the first sleeve and thus without disconnecting the first sleeve from the lower member, and, upon lowering of the upper member with the pipe string to a lower position with respect to the first sleeve, for rotating the first sleeve and thus permitting it to be threadably connected to or disconnected from the lower member, without rotating the second sleeve.

3. As in 2, wherein the sleeves are arranged concentrically of one another and the lower end of the upper member.

4. As in 3, wherein the second sleeve is arranged concentrically within the first sleeve.

5. As in 3 or 4, wherein the last mentioned means incudes first slots and lugs on the upper member and second sleeve non-rotatably engageable in the raised position of the upper member and second slots and lugs on the upper member and first sleeve non-rotatably engageable in the lowered position of the upper member.

6. As in 2, wherein the means connecting the second sleeve to the lower member comprises a pin on one and a recess in the other of the second sleeve and lower member, said spring being spring pressed into the recess when the first sleeve is threadably connected to the lower member.

* * * * *